US010381753B2

(12) United States Patent
Groeger

(10) Patent No.: US 10,381,753 B2
(45) Date of Patent: Aug. 13, 2019

(54) LOCKING HOUSING AND INTERFACE FOR WIPING ELECTRICAL CONTACTS

(71) Applicant: Brian Groeger, Levittown, PA (US)

(72) Inventor: Brian Groeger, Levittown, PA (US)

(73) Assignee: Rocal Corporation, Warrington, PA (US)

( * ) Notice: Subject to any disclaimer, the term of this patent is extended or adjusted under 35 U.S.C. 154(b) by 0 days.

(21) Appl. No.: 16/018,217

(22) Filed: Jun. 26, 2018

(65) Prior Publication Data

US 2018/0301826 A1 Oct. 18, 2018

Related U.S. Application Data

(63) Continuation-in-part of application No. 15/367,842, filed on Dec. 2, 2016, now Pat. No. 10,033,139.

(51) Int. Cl.

| | |
|---|---|
| ***H01R 4/48*** | (2006.01) |
| ***H01R 4/50*** | (2006.01) |
| ***H01R 13/193*** | (2006.01) |
| ***H01R 13/635*** | (2006.01) |

(52) U.S. Cl.
CPC ..... *H01R 4/4863* (2013.01); *H01R 4/5075* (2013.01); *H01R 13/193* (2013.01); *H01R 13/635* (2013.01)

(58) Field of Classification Search
CPC .... H01R 13/28; H01R 13/193; H01R 13/635; H01R 23/27; H01R 4/4863; H01R 4/5075
USPC ..... 439/295, 660, 924.1, 358
See application file for complete search history.

(56) References Cited

U.S. PATENT DOCUMENTS

| | | | | |
|---|---|---|---|---|
| 9,022,798 | B2 * | 5/2015 | Kida | H01R 13/506 439/358 |
| 10,033,139 | B2 * | 7/2018 | Sinton | H01R 24/28 |

* cited by examiner

*Primary Examiner* — Gary F Paumen
(74) *Attorney, Agent, or Firm* — Cusick IP, PLLC

(57) ABSTRACT

A locking coupling for electrical connections that provides a low-friction interface that delays contact between conductive contacts and retains electrical and mechanical connection with a locking mechanism. A terminal plug embodiment and a coupling embodiment are disclosed, a button release mechanism and a locking recessed mechanism are disclosed.

19 Claims, 13 Drawing Sheets

LOCKING HOUSING AND INTERFACE FOR WIPING ELECTRICAL CONTACTS

CROSS-REFERENCE TO RELATED APPLICATION

This application is a continuation-in-part of co-pending nonprovisional application Ser. No. 15/367,842 filed on Dec. 2, 2016. Application Ser. No. 15/367,842 is incorporated by reference in its entirety.

BACKGROUND OF THE INVENTION

Field of the Invention

The present general inventive concept is directed to a locking housing containing a durable low friction interface for connecting wiping electrical contacts, including genderless electrical contacts, in a locking coupling or electrical power connector to extend the life of electrical contacts.

Description of the Related Art

Modular electrical connections for batteries are well known. Co-pending application Ser. No. 15/367,842 discusses the prior art electrical connectors. The co-pending application discloses a durable low friction interface for connecting electrical connectors. Genderless electrical contacts are contained in housings and biased towards the center of the housing by leaf springs. The contacts on each side of the electrical connection typically present the same physical configuration with one side being rotated 180 degrees to present an inverted position. The electrical contacts have a sloping front side to guide the interfacing electrical connections to deflect in opposite directions, and are configured with a detent distal from the front side that retains the interfacing electrical contacts. Existing approaches rely on the force of a leaf spring and a medial section of the contact to retain the contacts and electrical connectors. The height of the medial section of the contact increases the movement off center and displacement of the contact against the leaf spring as one medial section displaces the other to offset the leaf spring from its resting position. As the medial sections move past each other, a position of maximum deflection is reached, after which deflection is reduced, spring force is reduced, and each medial portion engages a detent in the corresponding contact. This deflection and connection is simple and works the same way for insertion and for removal. In conventional contacts, disconnection is achieved with sufficient force to drag the medial sections across each other against the force of the leaf spring and friction. Connect disconnect cycles deflect the electrical contacts against the leaf spring. However, it is not always desirable to have the same force and method used for insertion, removal, and retaining the electrical and mechanical connection.

The rubbing contact of metal on metal can degrade the surface of the contacts over numerous connect disconnect cycles. Insertion and removal of electrical contacts require different amounts of force depending on the component composition and the configuration of the components to be connected. Materials that present less friction can lower the force required to operate the electrical connectors through connect disconnect cycles.

Relying on the tension of the electrical contact and the leaf spring leads to inconsistent results as electrical contacts are not installed into the housing in exactly the same configuration every time. Variances in the insulated conductors, cables, or electrical contact positions can create variations in connection geometry and therefore inconsistent physical and electrical performance. What is needed is a housing configured to provide consistent results independent of the installation of the electrical contact in the housing.

Wiping electrical contacts are known and widely used. The connect and disconnect cycles are sometimes performed while under load, or hot mating, so the arcing can have destructive effects on the metal surface of the contacts. What is needed is a housing that delays electrical contact until the electrical connectors have been substantially inserted and reduces the degradation of electrical contacts over connect disconnect cycles.

Genderless electrical contacts are suited for ease of connect-disconnect use. One widespread use of the flat wiping contacts is to connect batteries on equipment including lift trucks. When a battery is discharged, it can be disconnected from the application or equipment and connected to a charging device. Lift trucks and other applications involve movement, vibration, and other stresses. What is needed is a locking housing that remains securely connected while in use, yet can also be easily disconnected by a user when desired. A locking mechanism is needed that reduces the required force for connection for ease of use, yet provides additional protection against disconnect.

The prior art devices rely on a leaf spring to bias the connector towards the center of the housing. When two convex contacts are wiped against each other, the size of the convex bulge of the medial section determines the displacement of the connectors and leaf springs required to make the connection. Utilizing a convex contact of a higher size requires increased displacement, and therefore more force to make the connection and remove the connection. Convex contacts having a larger bulge are known as high detent contacts. Convex contacts having a smaller bulge are known as low detent contacts.

What is needed is an electrical connector with a durable low friction threshold that can increase the longevity of electrical contacts while augmenting connection retention in existing electrical connectors for flat wiping connect disconnect cycles. What is needed is a locking housing for a low friction interface that avoids reliance on friction and leaf spring tension to maintain the mechanical connection.

SUMMARY OF THE INVENTION

It is an aspect of the present invention to provide a locking housing for a durable low friction threshold for use in electrical connectors and an electrical connector comprising at least one low friction threshold. Reduced friction force can provide reduced wear on electrical contacts with continued use. Reduced friction force can increase the longevity of electrical contacts and electrical connectors by reducing frictional wear and material transfer due to galling. A locking housing is disclosed that both provides reduced friction force in a connect disconnect cycle while providing a locking structure to maintain a durable electrical connection in spite of the presence of low friction materials. The locking housing establishes consistent connection and provides structure that requires user intervention for disconnection while also avoiding friction, drag, and wear.

The above aspects can be obtained by a terminal plug for electrical connection defined by a housing and at least one ramp interface having a ramp surface, a ramp apex and an incline hook to retain an inserted electrical housing and retain an electrical contact in stable electrical connection with a lug. An additional ramp interface, incline hooks, and lug can be provided in the housing to form a dipole terminal plug. Parts of the ramp interface can be non-conductive to delay electrical connection between an electrical contact and the lug. A molded plastic ramp insert can be a ramp interface, and the entire ramp interface can be non-conductive. The housing comprises a release mechanism to allow disconnection of the inserted electrical contact.

Another aspect of the invention provides a coupling suited for connection on both sides. The coupling provides a low friction ramp interface on a first side with a locking mechanism for durable electrical connection. A second side of the coupling can provide a conventional connection, or a second ramp interface. An aspect of the invention is to provide interference between an inserted electrical contact and conductive elements in the coupling to delay initial conductive contact until a medial section of an electrical contact passes a ramp interface as described herein. A first ramp interface is provided with a rotating axis that cooperates with a locking mechanism to retain the electrical connection until user intervention releases the locking mechanism.

Another aspect of the invention is to provide a coupling with a first locking mechanism on a first side and a second locking mechanism on a second side. The first locking mechanism is more easily disengaged by a user for normal use whereas the second locking mechanism is less accessible to limit use. The various embodiments presented can all provide delayed electrical connection of a contact by interference of a ramp surface, and where the ramp surface comprises a low friction coefficient, a device of the invention provides increased durability, longevity, consistency, safety, and ease of use. Whereas reducing the friction of electrical contact medial sections scraping against each other is advantageous and provides ease of connection, increased security of connection is desired to maintain a sturdy connection. It has been discovered that reducing friction on insertion can also reduce friction for retention and removal. Instead of relying on the same forces and deflection for connect and disconnect, the present invention provides a different set of forces and mechanism governing the insertion and removal of an electrical contact.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
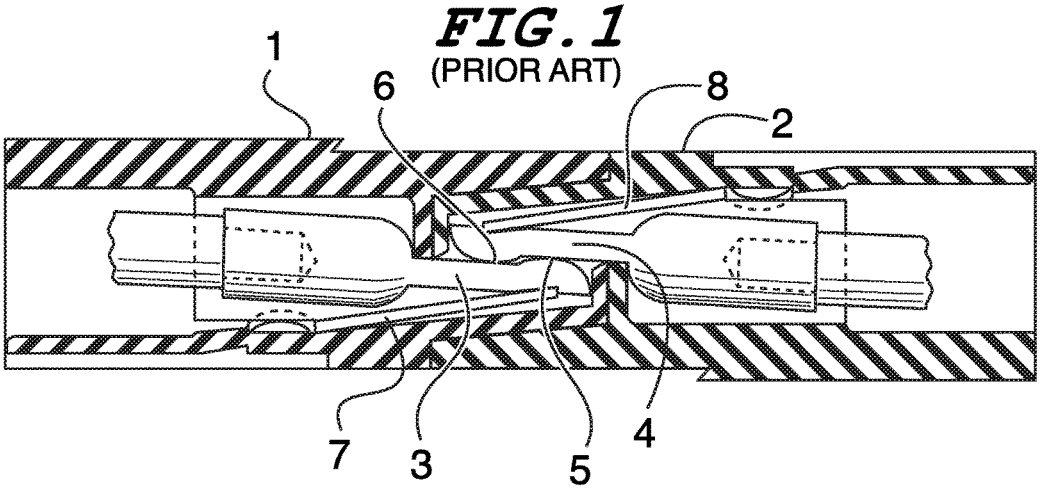
FIG. 1 (PRIOR ART)
FIG. 1 is a side view of a prior art electrical connection.

Reference will now be made in detail to the presently preferred embodiments of the invention, examples of which are illustrated in the accompanying drawings, wherein like reference numerals refer to like elements throughout.

The present inventive concept relates to a low friction interface for connecting a genderless electrical contact and an embodiment of a coupling providing at least one low friction interface. The present invention comprises an embodiment for accepting a genderless connector that reduces the metal to metal contact by presenting a rocking interface ramp anterior to an electrical conduit. In the prior art, two connectors are contained in housings and pushed together to create a friction fit. Each is biased towards the center of the housing by a leaf spring. The result is a friction connection and a friction fit. It is an object of the invention to provide a reduced friction interface to reduce wear and provide a locking housing to reliably retain the position and configuration of the connection until user intervention releases the locking mechanism of the locking housing. A ramp interface can comprise a grooved surface to provide a cleaning function upon insertion or removal of an electrical contact. Additional embodiments of the invention provide a locking terminal plug with a low friction interface and a locking coupling with a low friction interface.

FIG. 1 shows a prior art telescoped housing connection with two flat wiping electrical contacts. The subject matter is disclosed in U.S. Pat. No. 3,259,870 to Winkler. First connection housing 1 is connected to second connection housing 2 in telescoping arrangement. Housing 1 and 2 on each side of the drawing are the same configuration with one side rotated by 180 degrees so that the housings 1 and 2 telescope and first contact 3 and second contact 4 are joined by friction fit. Leaf springs 7, 8 bias the contacts towards the center of housings 1, 2. First medial section 5 and second medial section 6 have been inserted into the opposite housing across the corresponding medial section of the other contact.

This method of electrical connection has been successful and widely implemented along with numerous subsequent modifications. One of the problems with friction fit electrical contacts is that numerous connect disconnect cycles degrade the surface of the contacts. Galling can occur.

Figure 2:
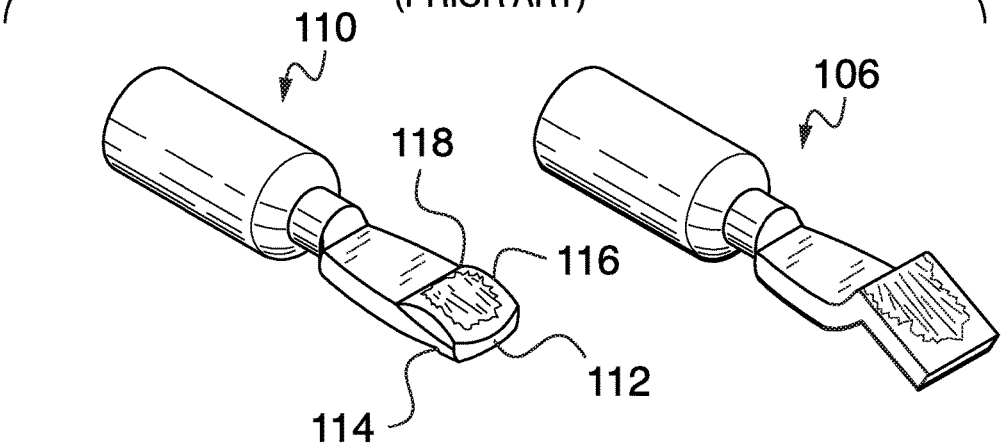
FIG. 2 (PRIOR ART)
FIG. 2 is a top view of degraded electrical contacts.

FIG. 2 shows a perspective view of electrical contacts that have been moderately or severely degraded over numerous connect disconnect cycles, i.e. normal use. An arcuate connector is shown as a high detent contact 110 with medial section 116 providing an offset bulge between front edge 112 and detent 118. Spring hook 114 is configured to retain a leaf spring (not shown) or other retaining feature. Planar connector 106 is shown as an alternative configuration.

Figure 3:
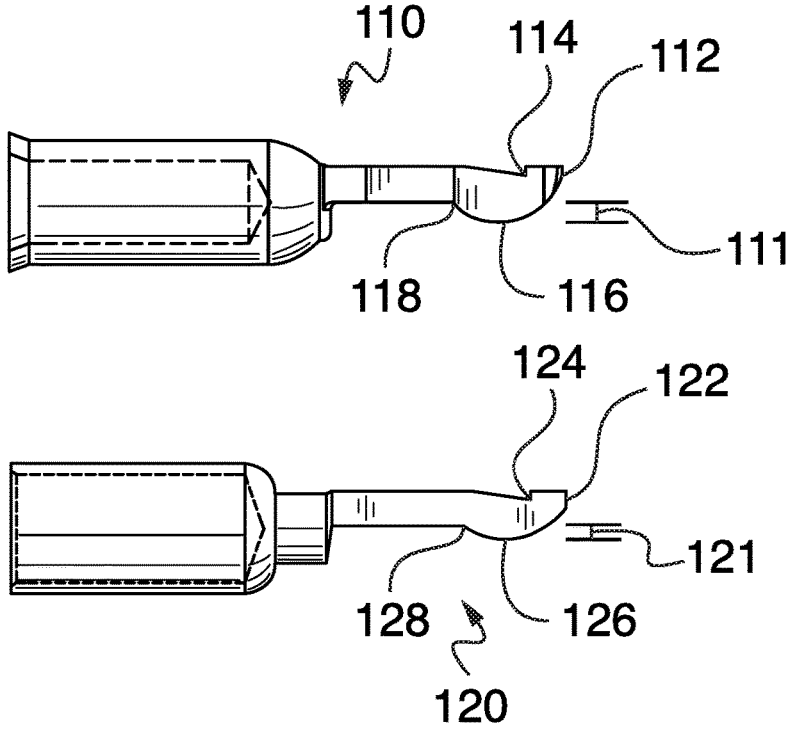
FIG. 3 is a side view of electrical contacts.

FIG. 3 presents a side view of arcuate high detent and low detent electrical contacts. These contacts are widely used in electrical connectors. Medial section 116 provides the offset movement upon insertion of the high detent contact 110. Medial section height 111 can be about $1/16^{th}$ of an inch. Low detent configurations can be utilized as in low detent contact 120 where medial section height 121 can be about $1/32^{nd}$ of an inch. Front edge 122, spring hook 124, medial section 126 and detent 128 are shown. Medial section height 111 dictates the amount of deflection from resting configuration required to achieve insertion of the contact 110 across a similarly configured contact to achieve a tensioned connection. The deflection of the contact increases as the contact is inserted, and the maximum deflection, caused by the medial section height, causes offset movement of the leaf spring and increases the forces of the contacts against each other and the friction force of the contacts against each other. As the medial section of one contact passes the center of the other medial section, the friction is reduced, the leaf spring offset is reduced, and the contacts snap into place. When connected, the medial section of each contact rests in the detent of the opposite contact. Friction retains the connection.

Figure 4:
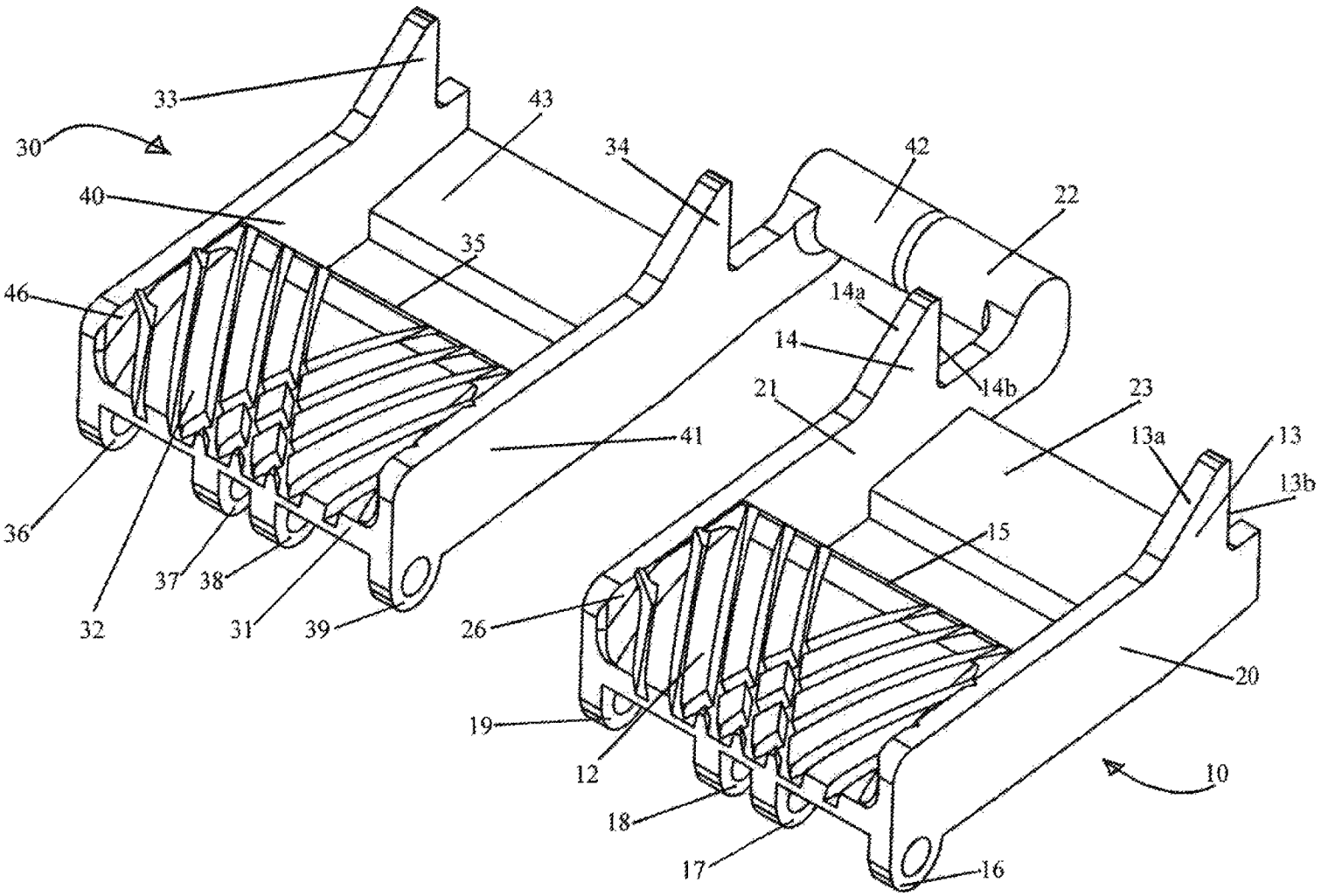
FIG. 4 is a perspective view of a pair of ramp inserts in an embodiment of the invention.

As discussed above, the friction of one contact against another results in degradation of the contact surface. An embodiment of the invention provides an interface that engages an inserted electrical contact and delays metal on metal contact until the electrical contact is at least partially inserted. An embodiment of the invention comprising a locking coupling with a rocking ramp threshold within a housing. A ramp interface engages an inserted electrical contact and can be provided by a ramp insert. FIG. 4 presents a perspective view of a pair of ramp inserts suited for use in a dipole coupling. As shown in the drawings, the ramp inserts are configured for insertion in a housing. First ramp insert 10 extends from first ramp front edge 11 to first release rod 22 and side wall 20 and side wall 21 are connected by ramp surface 12 and support member 23. Support member 23 is configured to retain an electrical conduit, not shown. Side wall 20 comprises first incline hook 13 extending away from side wall 20. Incline hook comprises an incline side 13*a* angled towards the direction of insertion from the front edge towards support member 23. Incline hook 13 comprises a retaining side 13*b* that can be a generally perpendicular surface facing the rear of the ramp insert to resist movement towards front edge 11. The retaining side 13*b* can be generally parallel to the front wall of an inserted electrical connector where this direction is generally perpendicular to the direction of travel of an inserted connector. A number of incline hooks configured like incline hook 13 can be utilized in an embodiment of the invention. For example, incline hooks 13, 14, 33, and 34 are shown in FIG. 4. Side wall 21 comprises second incline hook 14 extending away from side wall 21. Incline hook 14 comprises an incline side 14*a* and a retaining side 14*b*. The other incline hooks in the various figures can be formed in the same manner, each presenting an incline side and a retaining side. First ramp surface 12 is disposed between side wall 20 and side wall 21 and can comprise splayed grooves, not numbered for assisting with cleaning the surface of flat wiping electrical contacts. Side wall 21 extends to join first release rod 22. First ramp insert can comprise a plurality of pivot openings configured to receive a pivot member not shown. Inboard pivot opening 19, first central pivot opening 18, second central pivot opening 17, and outboard pivot opening 16 provide stability across the width of first ramp insert 10. First ramp surface 12 slopes upward and terminates at first ramp apex 15. Ramp inserts can be molded and can be formed with non-conductive materials, including plastic.

Second ramp insert 30 can be configured as the mirror image of first ramp insert 10. Second ramp surface 32 is positioned between side wall 40 and side wall 41. Second ramp surface 32 extends from second ramp front edge 31 to second ramp apex 35. Pivot openings 36-39 are shown adjacent second ramp front edge 31. Support member 43 is disposed between incline hooks 33 and 34. Second release rod 42 is connected to side wall 41. Retaining side ribs can help guide an inserted electrical contact. Each ramp insert can be formed with side ribs such as side rib 26 shown on the inboard side of ramp insert 10 and side rib 46 shown on the outboard side of ramp insert 30. Each of the ramp inserts can be formed with a vertical side rib with a rounded leading edge curved towards the ramp surface to guide an electrical contact towards the center of the ramp insert to ensure correct insertion and retention geometry. The ramp surface, for example ramp surface 12 can be formed with a plurality of splayed grooves. The grooves can intersect allowing any dirt or debris on an inserted electrical contact to be removed from the contact and collected in the grooves. Ramp surface 12 can be configured to interact with an inserted electrical contact of an electrical connector. A medial section of an inserted connector can push ramp surface 12 downward and cause rotation of the ramp insert. This configuration has the beneficial effect of moving incline hooks 13 and 14 downward to both begin the process of clearing the incline hooks, and also by nature of the rotation, reduce the incident angle encountered by a front edge of an electrical connector. As the incline side 13*a* and 14*a* move downward, the rise/run is decreased, and the encountered slope is decreased. This reduces impact and wear on the incline hooks on the various ramp inserts during connect disconnect cycles. The pressure of ramp surface 12 against an electrical contact also has the effect of deflecting a leaf spring associated with the contact and tensioning the contact so that it makes a solid connection with a conduit, not shown. Ramp inserts can be constructed with ramp surface heights that interact with larger or smaller medial sections of high detent, low detent, or other contact configurations. Utilizing a ramp insert that is non-conductive and low friction both delays electrical contact upon insertion and extends the life of a contact over more connect disconnect cycles.

Figure 5B:
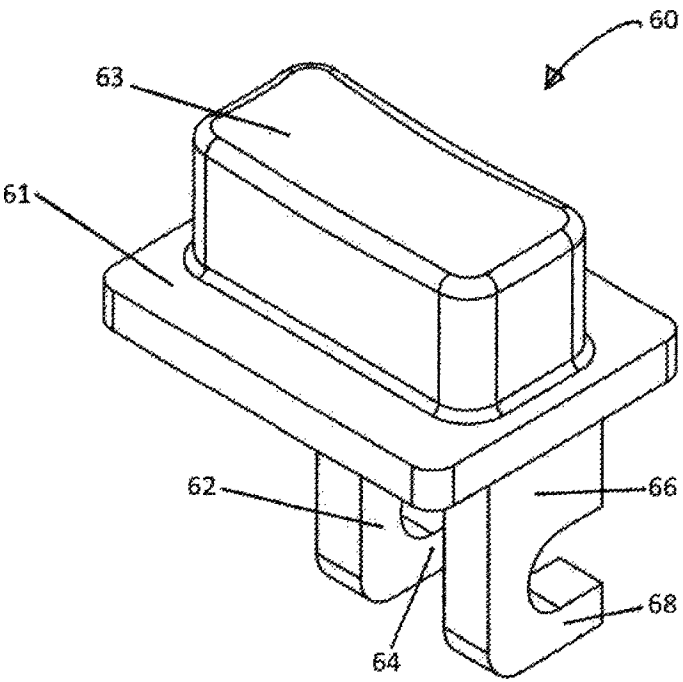
FIG. 5B is a perspective view a release actuator in an embodiment of the invention.
Figure 5A:
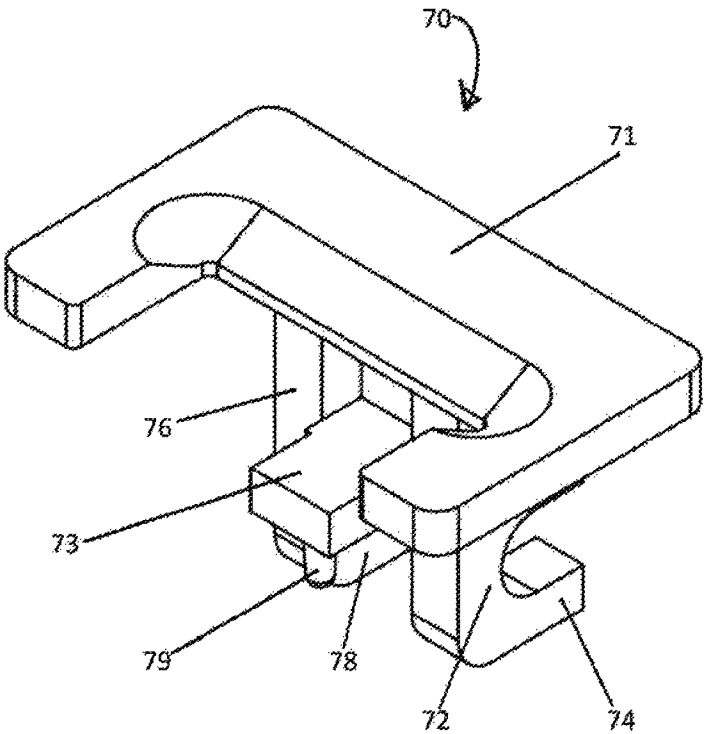
FIG. 5A is a perspective view of a service actuator in an embodiment of the invention.

FIG. 5A presents a perspective view of a service actuator 70. Service collar 71 is suited for position in a housing recess, not shown. Service receiver 73 is suited for receiving a force from an object such as a screwdriver. The service receiver 73 is recessed to restrict access. First locking extension 74 is disposed on first locking arm 72 and defines an opening suited to receive a release rod, not shown. Second locking extension 78 is disposed on second locking arm 76 and defines an opening suited to receive a release member, not shown. A release member can be a release rod as shown with the ramp inserts; cylinder or rounded shapes provide ease of movement. The release members can engage the locking extension and locking arm through a secure friction fit, being clipped in, or can be somewhat loosely engaged between locking extension 78 and locking arm 76 to more freely rotate during use. In an embodiment of the invention comprising a dipole coupling, the locking arms and locking extensions of the service actuator 70 move in unison. Second spring retainer 79 is configured to retain a spring that biases service actuator 70 away from the center of a housing, not shown. Release members can be configured to engage with locking mechanism in FIG. 5A or 5B interchangeably.

FIG. 5B presents a perspective view of a release actuator 60. Actuator collar 61 surrounds release receiver 63 which can be formed in the shape of a button. Release receiver 63 is positioned for ease of access so that a user can readily depress release receiver 63 to disconnect the housing of the invention. First release arm 62 combines with first release extension 64 to define an opening to receive a release rod, not shown. Second release extension 68 is disposed on second release arm 66 and defines an opening suited to receive a release rod, not shown. In an embodiment of the invention comprising a dipole coupling, the locking arms and locking extensions of the release actuator 60 move in unison.

Figure 6:
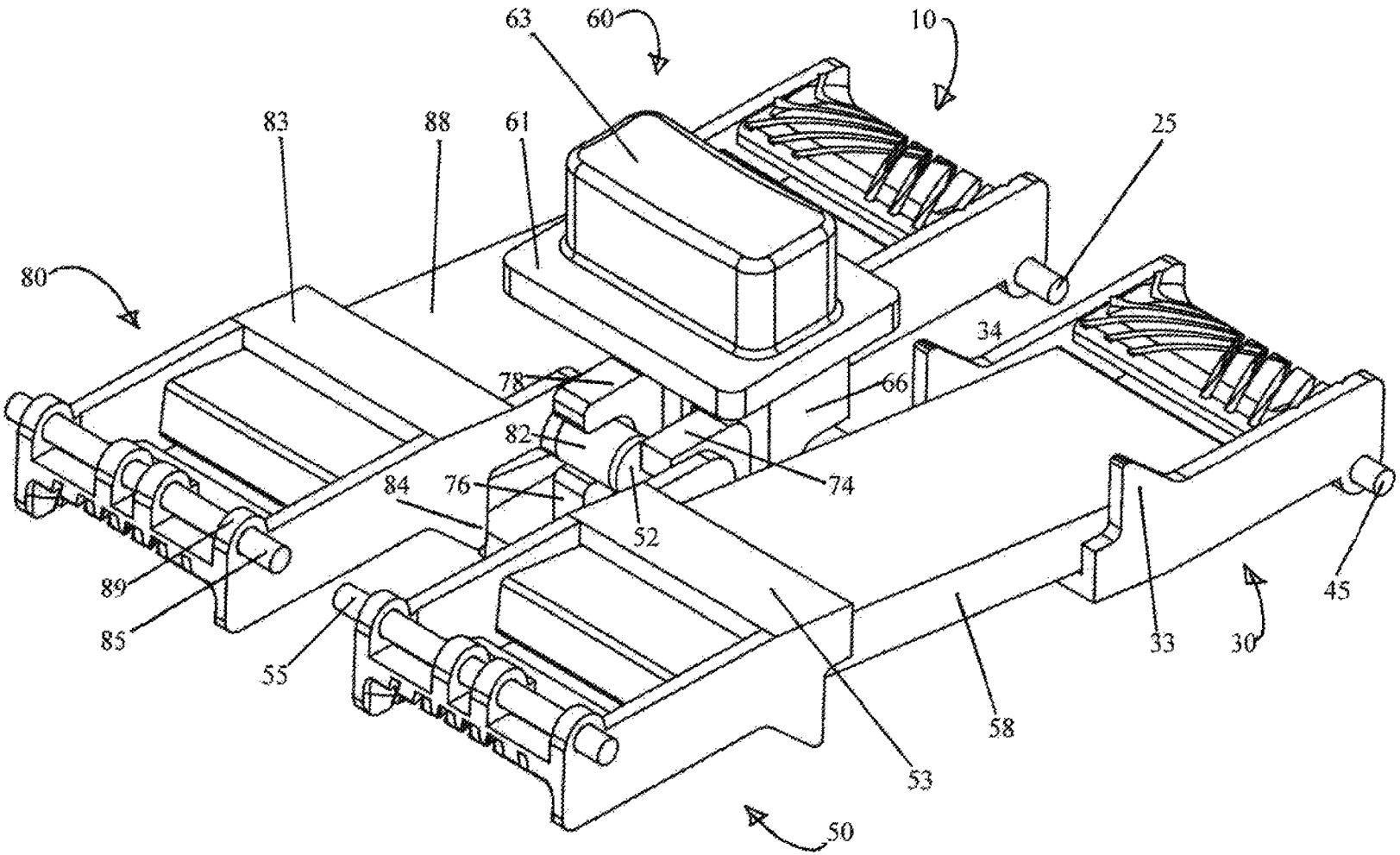
FIG. 6 is a perspective view of the mechanism of a dipole locking coupling in an embodiment of the invention.

FIG. 6 presents a perspective view of the mechanism of a dipole locking coupling in an embodiment of the invention. Two pairs of ramp inserts are shown. The first pair interfaces with release actuator 60. The second pair can be the same as the first pair of ramp inserts rotated to be inverted. The second pair of ramp inserts interfaces with service actuator 70. A pivot member allows for rotation of a structure about the member and can be a pivot rod formed in the shape of cylinder. For example, first ramp insert 10 is shown receiving first pivot rod 25. Second ramp insert 30 is shown receiving second pivot rod 45. Third ramp insert 50 is shown receiving third pivot rod 55, and fourth ramp insert 80 is shown receiving fourth pivot rod 85. Each of the pivot rods can be received by a plurality of pivot openings disposed in each ramp insert. Third ramp insert 50 comprises release rod 52 shown received adjacent first locking extension 74. Fourth ramp insert 80 comprises release rod 82 received between second locking arm 76 and second locking extension 78. A first conduit 58 is situated at one end in second ramp insert 30 and at a second end in third ramp insert 50 contacting support member 53. Second conduit 88 is situated at one end in first ramp insert 10 and at a second end in fourth ramp insert 80 contacting support member 83. The conduits can be formed of a conductive metal and can comprise a busbar.

Figure 7:
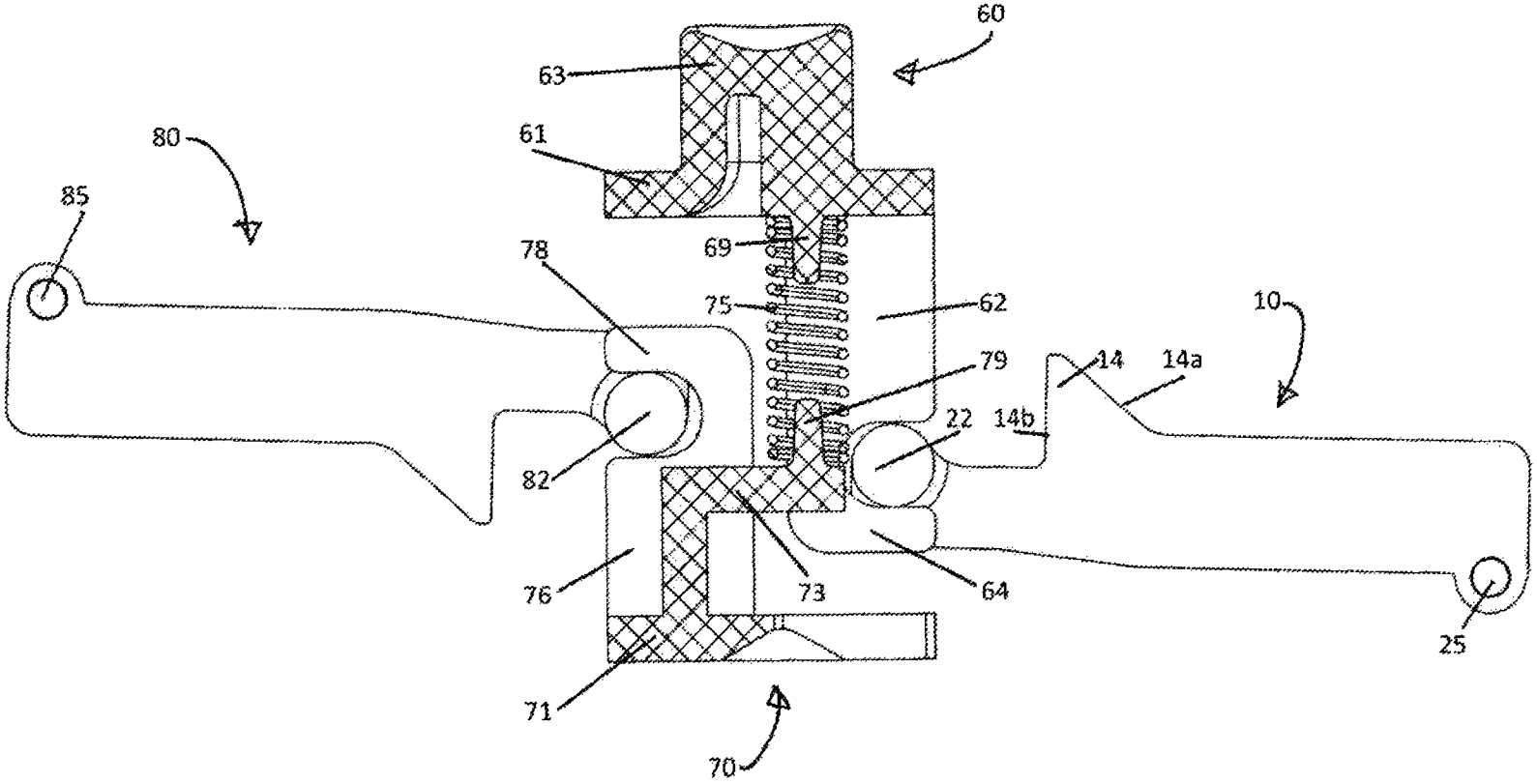
FIG. 7 is a section view of the mechanism of a dipole locking coupling in an embodiment of the invention.

FIG. 7 presents a sectional view of the mechanism of a dipole locking coupling in an embodiment of the invention also shown in FIG. 6. Spring 75 is shown at rest between first spring retainer 69 and second spring retainer 79. The spring 75 acts to move both release actuator 60 and service actuator 70 away from the center of the housing during operation. In the utilization of the assembled device, when release receiver 63 is pressed by a user, it overcomes the resistance of spring 75 to move first release arm 62 and the second release arm 66, not shown, downward. This moves first release rod 22 a corresponding distance. As first ramp insert 10 is retained at a front end by first pivot rod 25, the effect is to pivot the entirety of first ramp insert 10 about the first pivot rod 25. Incline hook 14 is therefore moved downward allowing removal of an inserted electrical connector, not shown. When a user removes pressure on release receiver 63, it returns to its protruding position and therefore first release arm 62, first release rod 22, and incline hook 14 return to the positions shown in FIG. 7. Insertion of an electrical connector, not shown, interfaces with incline side 14*a* and moves incline hook 14 downward and also moves release actuator 60 into the housing, not shown, and compresses spring 75. Thus release actuator 60 is moved into the housing by either pressing release receiver 63, or by insertion movement against incline side 14*a* of incline hook 14. Similarly, when service receiver 73 is pressed, second locking arm 76 and second locking extension 78 move in tandem to raise fourth release rod 82 and pivot fourth ramp insert 80 about fourth pivot rod 85. Service receiver 73 can be recessed as shown in FIG. 7 to restrict release of that side of the mechanism. The opening in service collar 71 can be configure to accept a tool of a particular shape or size to restrict access. Service collar 71 is configured to retain service actuator 70 within a housing, not shown. Releasing service receiver 73 allows the body of service actuator 70 and fourth ramp insert 80 to return to the position shown in FIG. 7, aided by spring 75. The spirit of the invention can be practiced with monopole, dipole, tripole etc. electrical connectors. Exemplary illustrations are included showing a dipole connector with one easy access actuator and one restricted access service actuator. It will be understood that different combinations of ramp inserts and actuators can be utilized in the scope of the invention.

Figure 8:
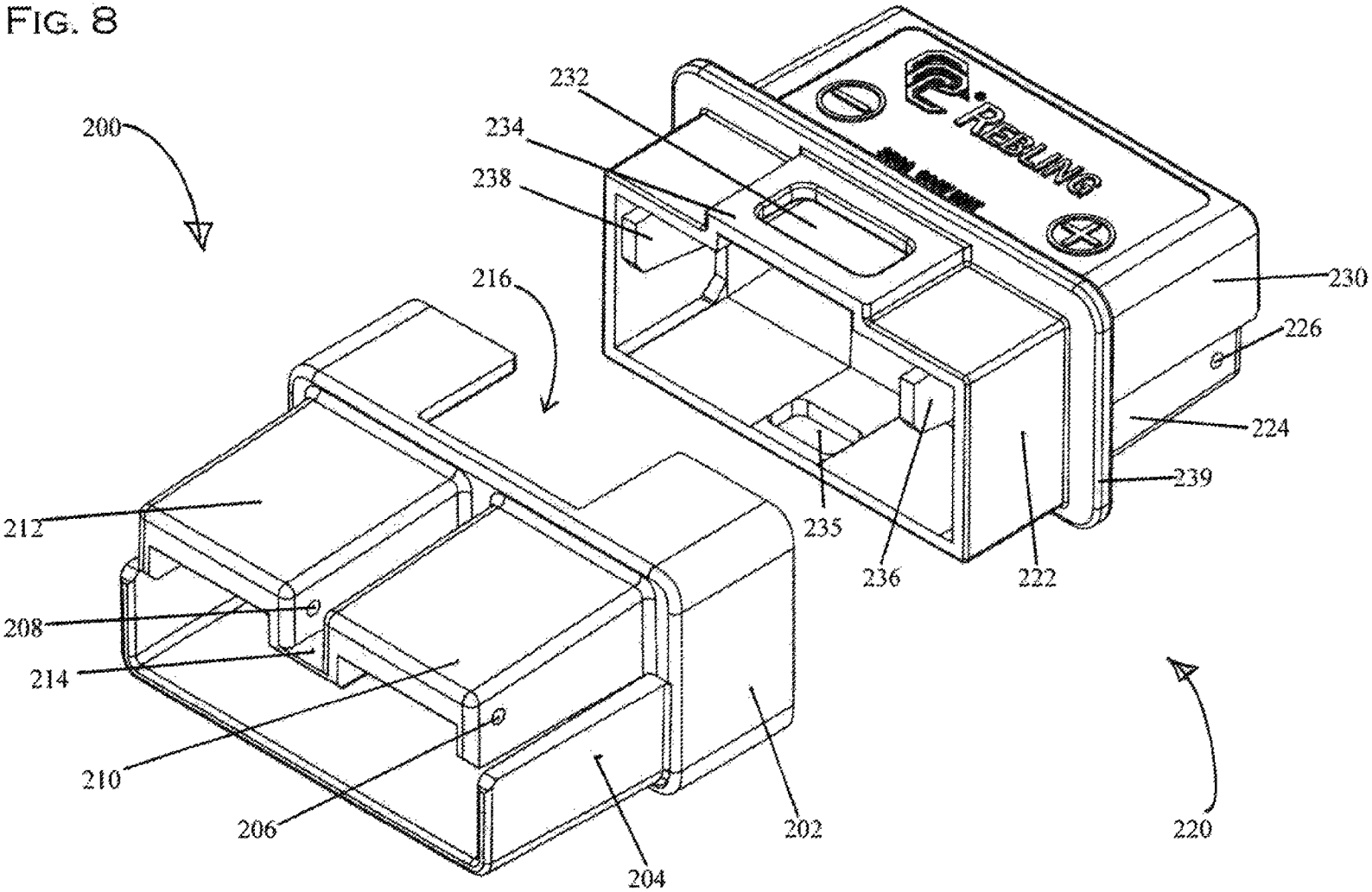
FIG. 8 is a perspective view a coupling housing in an embodiment of the invention.

FIG. 8 presents a perspective view of a coupling housing in an embodiment of the invention. In a particular embodiment of the invention, the housing can be molded and assembled comprising a housing front 220 and a housing rear 200. Housing rear 200 can comprise a rear shroud 204 connected to a rear housing surround 202. Rear shroud 204 and rear channel guides 210 and 212 combine to define a housing rear passage, not numbered, suited for insertion of an electrical connector, not shown. First rear channel guide 210 comprises pivot rod access 206 configured to receive a pivot rod, for example pivot rod 55. Second rear channel guide 212 comprises pivot rod access 208 configured to receive a pivot rod, for example pivot rod 85. A pivot rod access can be an opening present on both sides of a channel guide for ease of alignment and insertion. Guide bridge 214 is positioned between first and second rear channel guides and helps align an inserted electrical connector, not shown. Housing cutout 216 is configured to interface with front housing insert 222 and release apron 234 to provide alignment and stability between housing front 220 and housing rear 200. Release recess 232 is open and configured to receive release receiver 63. Release apron 234 is raised and configured to receive and retain actuator collar 61 within the housing. Housing flange 239 can be configured to arrest the movement of rear housing surround 202 onto front housing insert 22 and provide a stop. Front shroud 230 is configured wider than second front channel guide 224 to interface with existing electrical connectors. Front shroud 230 and the front channel guides together define another housing front passage, not numbered, suited for receiving an electrical connector. Pivot rod access 226 is configured to receive a pivot rod, for example pivot rod 45. Pivot rods can be provided with a knurled end that increases friction with housing openings, e.g. pivot rod access 206. The pivot rods also can be knurled on both ends. The body of a pivot rod is preferably smooth for ease of rotation of e.g. clip opening 16 about the pivot rod in the operation of the device. Service recess 235 is shown in the bottom of front housing insert 222 and allows access to service receiver 73, not shown. Busbar support 236 and busbar support 238 can be configured to aid in the alignment of the housing front 220 and housing rear 200 when connected with electrical conduits, not shown.

Figure 9:
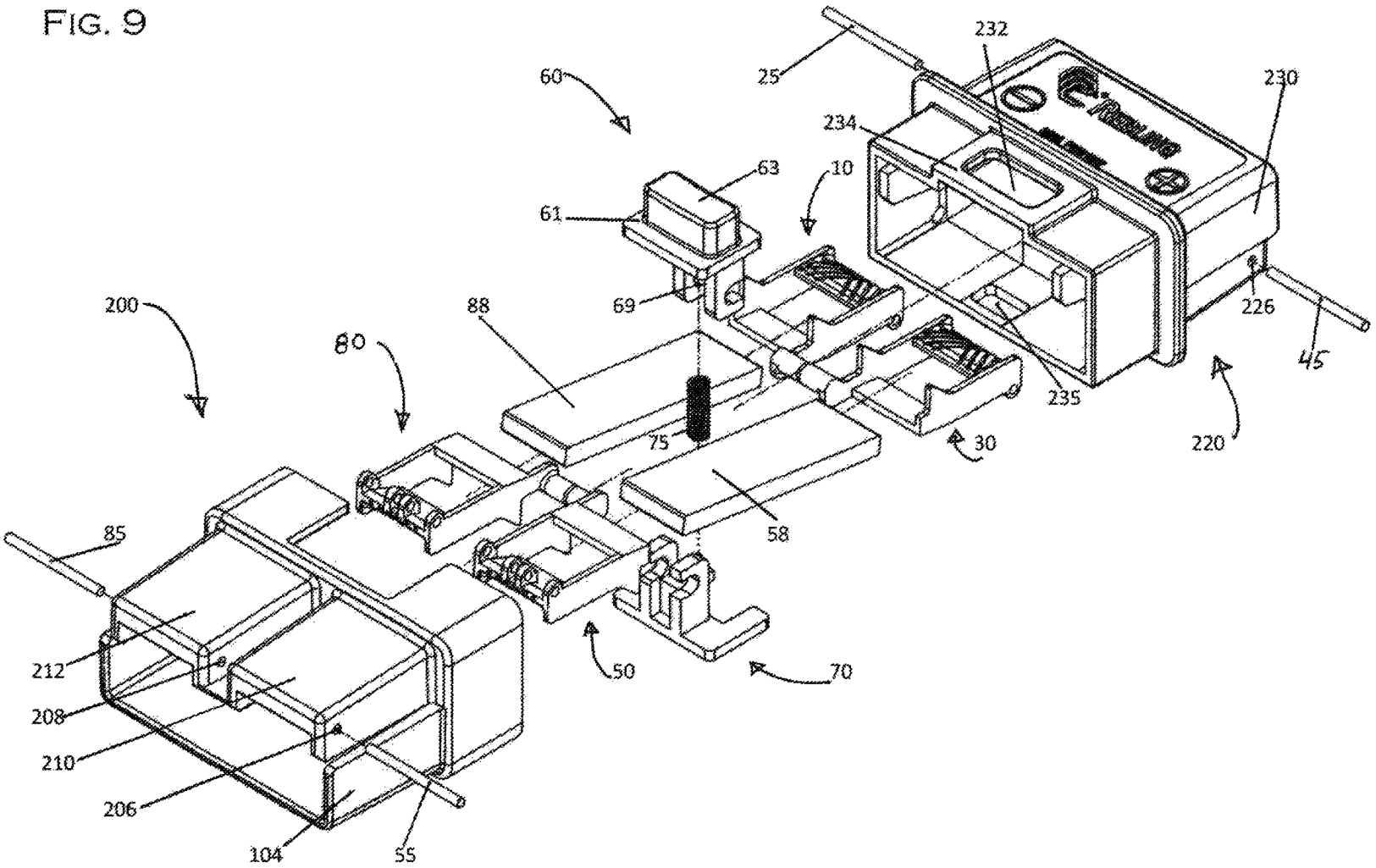
FIG. 9 is an exploded view of a locking coupling in an embodiment of the invention.

FIG. 9 presents an exploded view of a locking coupling in an embodiment of the invention. The locking housing can be constructed by inserting first ramp insert 10 into housing front 220 and inserting first pivot rod 25 through a pivot rod access, not shown, to intersect each of a plurality of pivot openings, for example the outboard pivot opening 16 through to the inboard pivot opening 19 show in FIG. 4. Second ramp insert 30 can be inserted in to housing front 220 and retained by second pivot rod 45 inserted into pivot rod access 226. First conduit 58 can be placed in second ramp insert 30 and second conduit 88 can be placed in first ramp insert 10. Release actuation 60 can be engaged with the release rods as shown in FIG. 6 and spring 75 can be placed on first spring retainer 69 and second spring retainer, not shown. Release receiver 63 can be placed in release recess 232 with service actuator 70 placed above service recess 235. Service actuator 70 can then be connected to the release rods of third ramp insert 50 and fourth ramp insert 80 which are in turn retained within housing rear by third pivot rod 55 and fourth pivot rod 85. The pair of ramp inserts 50 and 80 can be constructed in the same manner as the pair of ramp inserts 10 and 30, each having a release rod configured to engage either a service actuator or a release actuator for movement of the ramp insert about the respective pivot rod. Housing rear 200 can be completed by inserting fourth ramp insert 80 and the inserting fourth pivot rod 85 through a pivot opening, not shown through to pivot opening 208 to assemble the locking coupling.

In an alternate embodiment of the invention the release actuator can be formed with incline hooks integrated into the release arm. In this embodiment, actuating the release member causes linear motion of the incline hook or hooks in the same direction as the movement of the release arm.

Figure 10A:
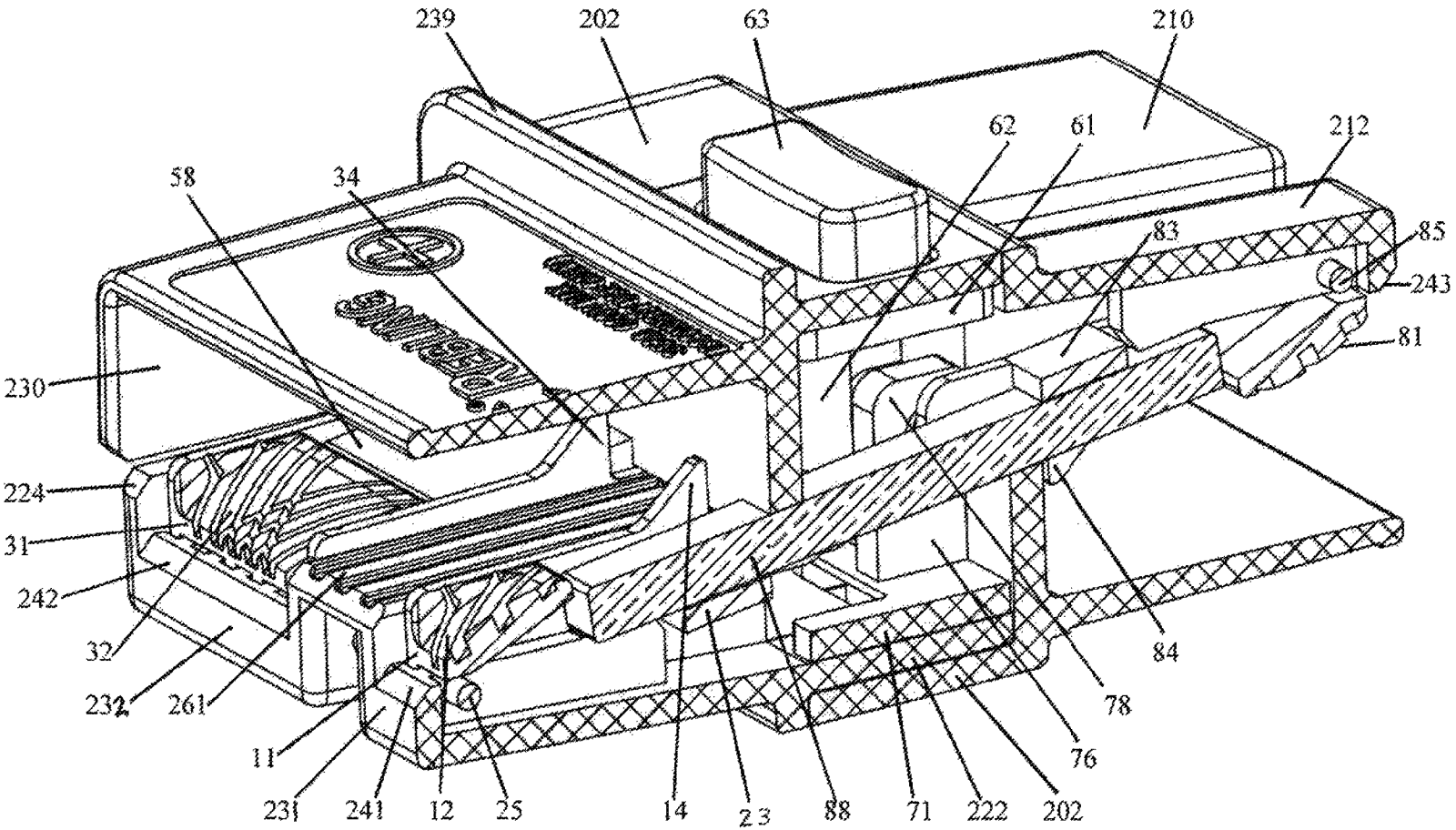
FIG. 10A is a sectional view of a locking coupling in an embodiment of the invention.

FIG. 10A presents a sectional view of a locking coupling in an embodiment of the invention. First pivot rod 25 is shown in cross section below ramp surface 12. Actuator collar 61 is shown below release apron 234. Vented bridge surface 261 helps an inserted electrical connector slide inward and be removed. Vents and ridges prevent a tight seal or vacuum that would increase resistance. First front channel ramp 241 disposed on first front channel 231 and second front channel ramp 242 disposed on second front channel 232 each help guide the front edge of an electrical connector into the locking housing. Service collar 71 is shown below front housing insert 222 and rear housing surround 202. Second conduit 88 is shown between support member 23 on one end and support member 83 on the other end. The conduit also can be held in place by the interior walls of the housing, not numbered. Insertion of an element against incline side 14*a* of incline hook 14 causes the entire ramp insert to pivot around first pivot rod 25 and pull release receiver 63 into the housing. When the inserted element clears the apex of incline hook 14, release receiver 63 returns to its resting position, showing in FIG. 10A.

Figure 10B:
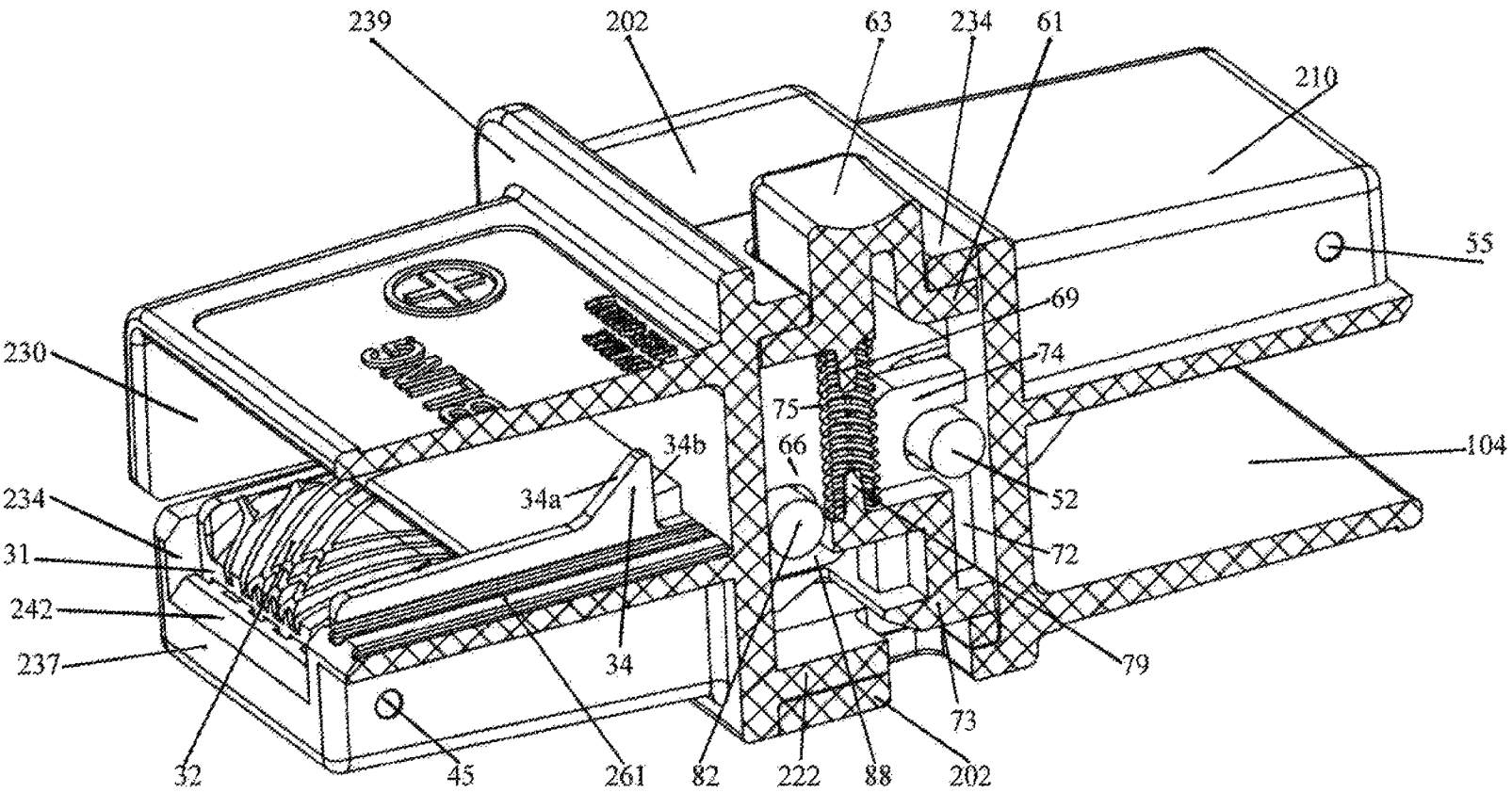
FIG. 10B is a sectional view of a locking coupling in an embodiment of the invention.

FIG. 10B presents an additional sectional view of a locking coupling in an embodiment of the invention. Fourth release rod 82 is structurally connected to incline hook 34. Insertion of an electrical connector against incline side 34*a* of incline hook 34 will cause the fourth release rod 82 to move downward and compress spring 75. Upon full insertion, spring 75 causes second release extension 66 and fourth release rod 82 to move upward, returning incline hook 34 to its resting position and the retaining side 34*b* of the incline hook 34 prevents removal of an inserted electrical connector.

Figure 11A:
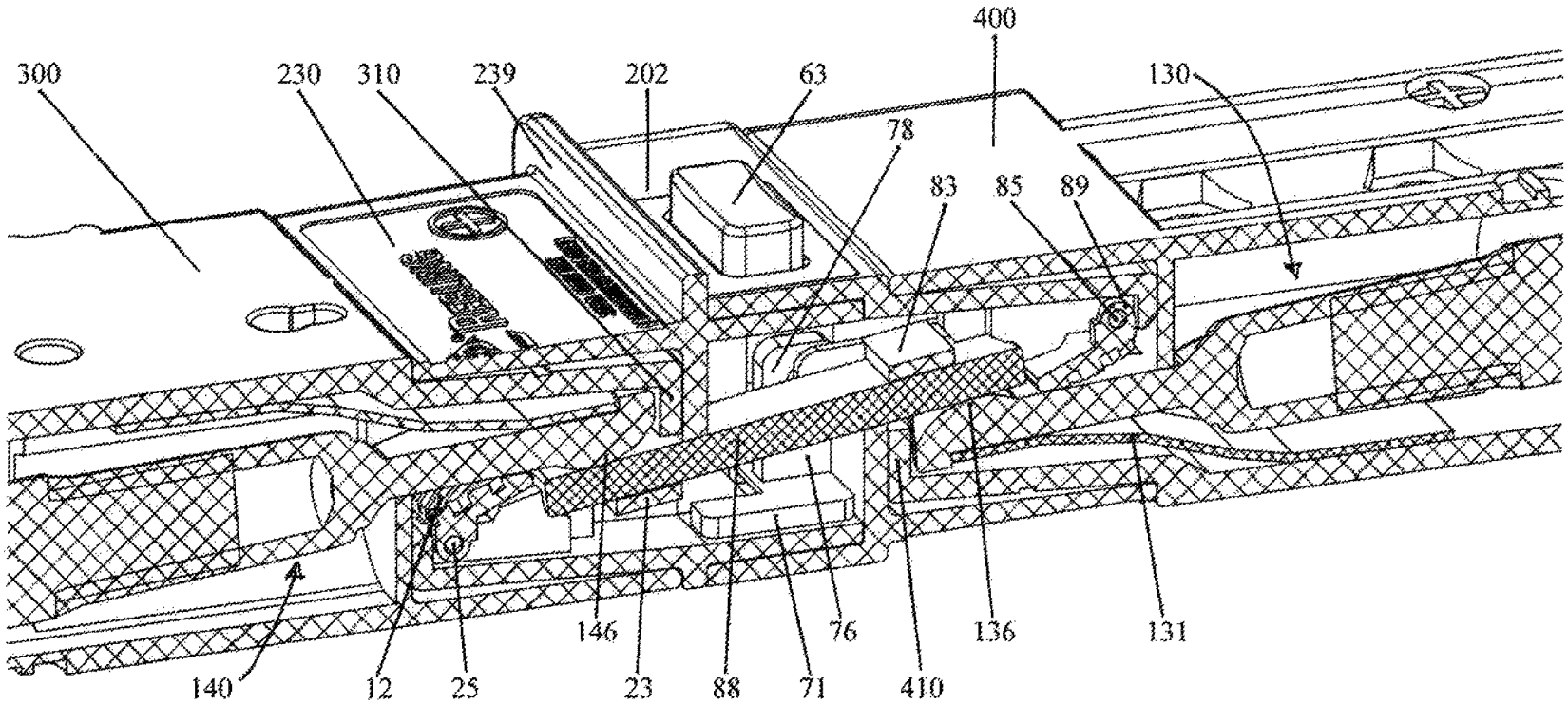
FIG. 11A is a sectional view a locking coupling in an embodiment of the invention connecting two conventional genderless connectors.

FIG. 11A presents a sectional view of a locking coupling of the invention connected to a conventional electrical connector on each side. First electrical connector 300 is connected to the locking coupling inside front shroud 230. First connector front edge 310 is shown perpendicular to the direction of insertion. First electrical contact 140 comprises medial section 146 and is retained in first electrical connector and tensioned towards the center of the connector 300 by first leaf spring 141. Medial section 146 is shown contacting second conduit 88. Insertion of medial section 146 across ramp surface 12 causes deflection of leaf spring 141 and also causes the ramp insert to move downward against the force of spring 75. When the medial section 146 clears the ramp apex 15, and front edge 310 clears the incline sides 13*a* and 14*a*, leaf spring 141 tensions medial section 146 against conduit 88 and spring 75 returns incline hooks 13 and 14 so that the retaining sides 13*b* and 14*b* are interfacing with front edge 310 to prevent removal. Similar function occurs with ramp insert 30 in a dipole embodiment of the invention.

The geometry of the mechanism of the locking coupling can be selected so that the front edge 310 clears the incline side of the ramps at the same time and the inserted electrical contacts both clear the ramp apexes at the same insertion distance and same time. The incline hooks can be positioned relative the ramp apex so that the medial section of an inserted electrical contact clears the ramp apex (clearance event) at the same time and insertion distance as the front edge 310 clears the incline side of the incline hook (a second clearance event), or adjustments can be made so that one clearance event happens prior to the other as desired in the functioning of the locking coupling.

Second electrical connector 400 is shown connected to rear housing surround 202. Second connector front edge 410 is shown perpendicular to the direction of insertion and precedes second electrical contact 130 on insertion. Medial section 136 contacts second conduit 88 to electrically connect first electrical contact 140 with second electrical contact 130. Leaf spring 131 tensions medial section 136 towards the center of the housing and against second conduit 88. Operation of the ramp surfaces and incline hooks against the medial section 136 of contact 130 and front edge 410 of electrical connector 400 operates in the same manner as the electrical connector 300. The presence of service actuator 70 interfacing with the ramp inserts on the "service" side of the coupling means that disconnection can be attained by inserting an appropriate sized tool to activate the service actuator 70 and release electrical connector 400.

Figure 11B:
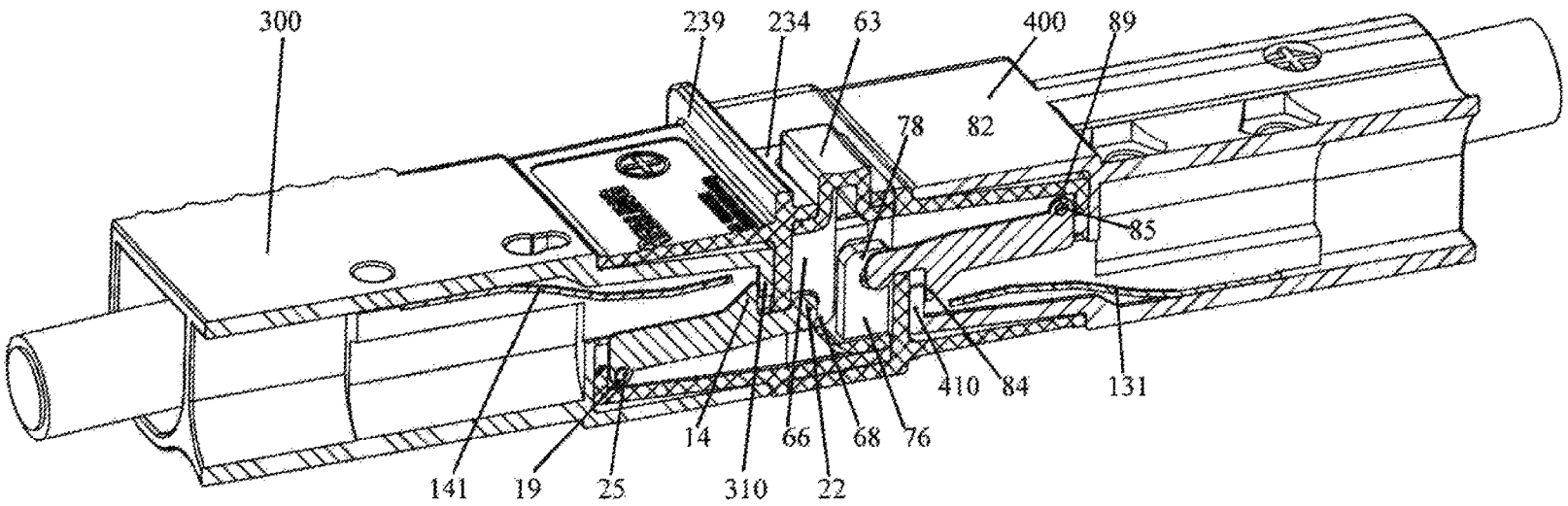
FIG. 11B is a sectional view a locking coupling in an embodiment of the invention connecting two conventional genderless connectors.

FIG. 11B is an additional sectional view of a locking coupling of the invention as shown in FIG. 10. Incline hook 14 has been cleared by first connector front edge 310. Upon insertion of first electrical connector 300 into the locking coupling, the front edge 310 encounters incline hook 14 and pushes the entire ramp insert downward. This brings the actuator assembly downward against the tension of the spring 75, not shown. After clearing the incline side 14*a* to the apex of incline hook 14, the entire ramp insert returns to resting position, and the first electrical connector 300 is retained against removal by retaining side 14*b* of incline hook 14 and the three other incline hooks on the pair of ramp inserts on this side of the housing. Removal of first electrical connector 300 not shown in this view. Removal of electrical connector 300 requires user intervention by pressing release receiver 63 to pivot the insert ramps connected to release actuator and depress, for example, incline hook 14. In this way, release receiver 63 can be configured as a button that allows a user to easily disconnect the locking coupling from electrical connector 300.

Second electrical connector 400 can be inserted in the same manner against the incline hook of, for example, fourth ramp insert 80. The insertion of second connector front edge interacts with incline hook 84 and moves second locking arm 76 and thereby entire locking actuator 70 toward the center of the housing. A medial section of an inserted contact, or pair of contacts, interfaces with the ramp surface(s) to begin deflection of the incline hooks and rotation of the ramp insert against spring 75. This causes a force-balanced deflection of, for example, leaf spring 131. After clearing the apex of incline hook 84, locking actuator is returned to its resting position by the spring and the incline hooks on the ramps provide a structural barrier to removal of the second electrical connector 400 from the locking coupling. Disconnection can be accomplished by insertion of a suitably shaped object into service recess 235 to move service actuator 70 and cause ramp insert, e.g. 80, to pivot on fourth pivot rod 85 and move incline hook away from second connector front edge 410 to allow second electrical connector 400 to be removed from the locking coupling. Leaf spring 131 provides tension to maintain electrical contact. However, depressing service actuator 70 allows the contact and connector 400 to be removed without having to drag medial sections across the medial sections of other electrical contacts.

Tension of leaf spring 141 keeps electrical contact of 140 pressed against conduit 88 whereas incline hook 14 prevents removal of first electrical connector 300 by retaining first connector front edge 310. The coupling can provide the same function on the side with second electrical connector 400 and can optionally provide a different locking mechanism through the use of, for example, a service actuator.

Figure 12:
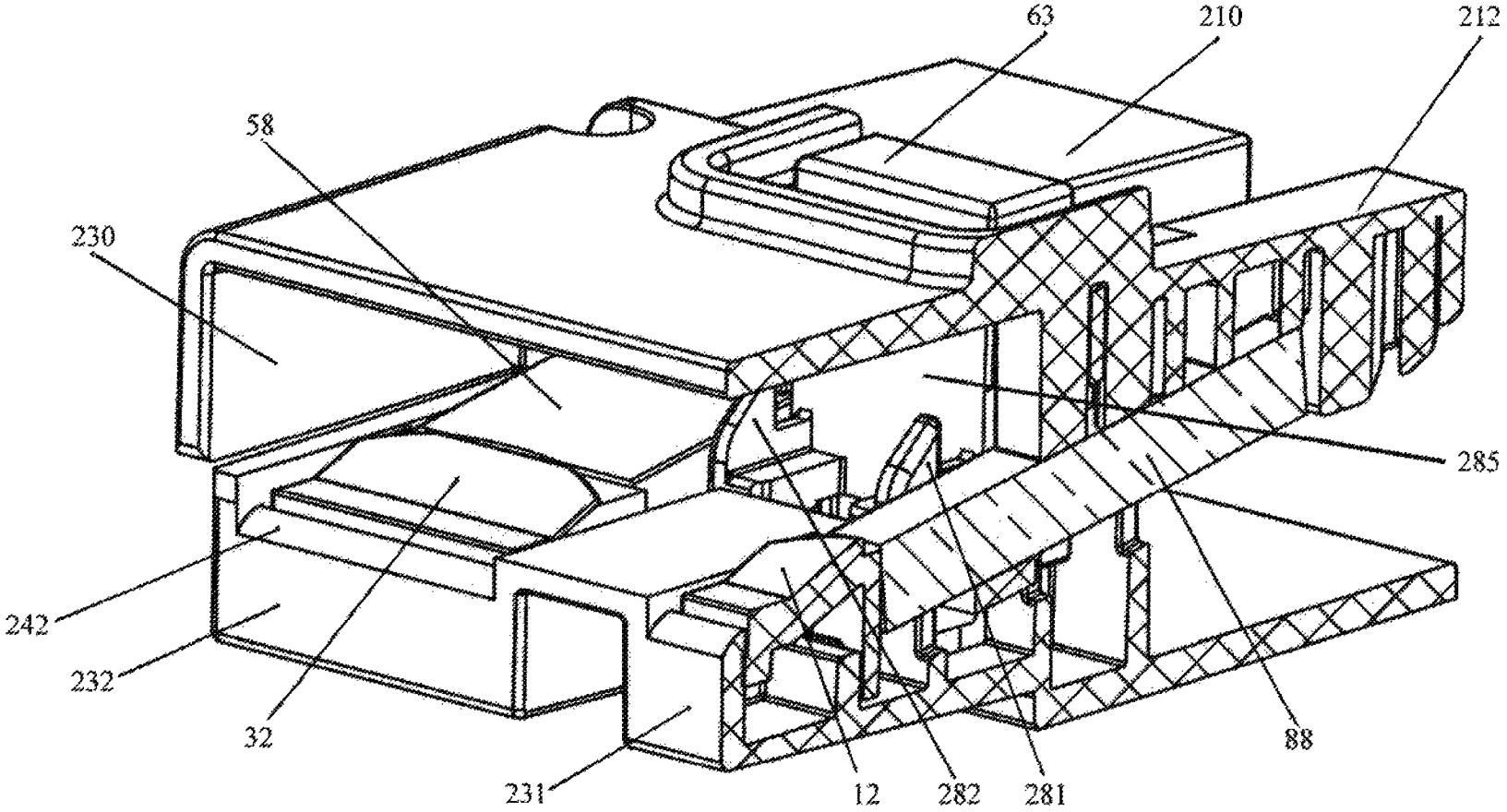
FIG. 12 is a sectional view of a locking coupling in an embodiment of the invention with integrated release hooks.

FIG. 12 presents a locking coupling in an embodiment of the invention with integrated release hooks. Release receiver 63 can be formed integrated with a unitary release arm that is joined to one or more incline hooks. For example, integrated release arm 285 is shown configured for reciprocal movement by activating release receiver 63 in and out of the housing. A spring, not shown, can bias the integrated release arm towards the housing and return the mechanism to a resting position. Insertion of an electrical connector presents a front edge 310 to encounter first integrated release hook 281 and second integrated release hook 282 and push the hooks out of the path of the inserted electrical connector. Upon clearing the incline hooks, a spring returns the hooks to the resting position. As discussed herein, each incline hook can have an incline side facing a housing passage and a retaining side facing away from the housing passage. Retaining sides of the hooks can be substantially parallel to front edge 310 of an inserted connector. Integrated release arm 285, release receiver 63, and integrated release hooks 281 and 282 can be formed of molded material, for example molded plastic, to form a unitary structure that moves in unison.

In another embodiment of the invention, the ramp interface can be combined with electrical connectors in the form of lugs to provide a terminal plug. The terminal plug can comprise a release actuator connected to a ramp insert or a pair of ramp inserts in a housing to form a dipole terminal plug. The lugs can be mechanically connected to conventional insulated electrical conduits by crimping or other known methods and connected to various applications. In an embodiment, the service actuator can be omitted as the service side is consistently connected. Exemplary lugs are shown in, for example, FIG. 7A of the co-pending application Ser. No. 15/367,842, and conventional electrical connector 170 is depicted that can be connected to the various dipole embodiments disclosed herein. Lugs such as element 240 in that Figure can replace conduits numbered as 58 and 88 in the present application with an electrically conductive element connected to a cable or wire that can be insulated. A terminal plug can be adapted to an application such as a lift truck so that conventional electrical connectors can be easily connected and disconnected. The incline hook of the ramp insert serves to retain the connection until a user intervenes by utilizing the release actuator.

The many features and advantages of the invention are apparent from the detailed specification and, thus, it is intended by the appended claims to cover all such features and advantages of the invention that fall within the true spirit and scope of the invention. The various elements of the disclosed embodiments can be combined to provide couplings, plugs, and connections that are suited for use with electrical contacts such as high detent contact 110, low detent contact 120 or planar connector 106. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A locking coupling for electrical connection between a first and a second electrical connector comprising:

a housing having a housing front and a housing rear;

said housing front is configured to receive a first electrical connector;

said housing rear is configured to receive a second electrical connector;

a first ramp interface disposed in said housing and configured to pivot around a pivot member;

said first ramp interface comprising a first ramp surface, an incline hook, at least one pivot opening, and a first release member;

said incline hook comprises an incline side facing a housing passage and a retaining side facing away from said housing passage;

a release actuator engaging said first release member wherein movement of said release actuator effects movement of said first release member and causes said first ramp interface to pivot around said pivot member;

a first electrical conduit having a first end disposed in said first ramp interface adjacent said first ramp surface;

said pivot member intersecting said at least one pivot opening; and said first ramp surface is non-conductive.

2. The locking coupling of claim 1 wherein said first ramp interface comprises a second incline hook comprising an incline side facing said housing passage and a retaining side facing away from said housing passage.

3. The locking coupling of claim 1 wherein said first ramp surface is configured to engage an electrical contact of an inserted first electrical connector and cause said ramp insert and said incline hook to rotate about said pivot member.

4. The locking coupling of claim 1 further comprising:

a second ramp interface disposed in said housing, said second ramp interface comprising a second ramp surface, a second pivot opening, and a second release member;

a second electrical conduit disposed in said second ramp interface adjacent said second ramp surface;

a second pivot member intersecting said second pivot opening;

said second release member engaged with said release actuator wherein moving said release actuator causes movement of said second release member and causes said second ramp interface to pivot around said second pivot member.

5. The locking coupling of claim 4 further comprising:

a third ramp interface disposed in said housing, said third ramp interface comprising a third ramp surface, a second incline hook, a third pivot opening, and a third release member;

said second electrical conduit extending to said third ramp interface;

a third pivot member intersecting said third pivot opening;

said third release member engaging a locking arm of a locking actuator wherein moving said locking actuator causes movement of said third release member and causes said third ramp interface to pivot around said third pivot member;

a fourth ramp interface disposed in said housing, said fourth ramp interface comprising a fourth ramp surface, a fourth pivot opening, and a fourth release member;

said first electrical conduit extending to said fourth ramp interface;

a fourth pivot member intersecting said fourth pivot opening;

said fourth release member connected to said fourth ramp interface and engaging said locking actuator wherein moving said locking actuator causes movement of said fourth release member and causes said fourth ramp interface to pivot around said fourth pivot member.

6. The locking coupling of claim 5 wherein:

said release actuator further comprises a release receiver configured to protrude out of said housing, an actuator collar configured to be retained within said housing, and a spring to bias the position of said release actuator against said housing.

7. The locking coupling of claim 6 wherein:

said locking actuator comprises a service collar configured to be retained within said housing and a service receiver configured to be recessed within said housing wherein movement of said service receiver moves said locking actuator against said spring, and said spring biases said locking actuator against said housing.

8. The locking coupling of claim 4 further comprising:

a third ramp interface comprising a third ramp surface, a third release member, and third incline hook;

a fourth ramp interface comprising a fourth ramp surface, a fourth release member, and a fourth incline hook;

a second incline hook disposed on said second ramp interface;

wherein a locking actuator engages said third release member and said fourth release member and movement of said locking actuator causes said third ramp interface and said fourth ramp interface to rotate within said housing.

9. The coupling of claim 8 further comprising:

a spring having a first end engaged with said release actuator to bias said release actuator in a first direction towards said housing, said spring having a second end engaged with a locking actuator to bias said locking actuator in a second direction towards said housing.

10. The locking coupling of claim 1 wherein said first ramp surface comprises splayed grooves and terminates in a first ramp apex.

11. The locking coupling of claim 10 wherein said first ramp surface further comprises a first side rib curved towards said first ramp surface and a second side rib curved towards said first ramp surface.

12. The coupling of claim 1 wherein said pivot member comprises a first end engaged in a first pivot rod access disposed in said housing, and a second end engaged in a second pivot rod access disposed in said housing.

13. A terminal plug for electrical connection with an electrical connector comprising:

a housing having a housing front and a housing rear;

a first ramp interface disposed in said housing, said ramp interface comprising a first ramp surface, an incline hook, at least one pivot opening, and a release member;

a first lug disposed in said housing adjacent said first ramp interface wherein said first lug is conductive and a distal end is configured for electrical connection;

a pivot member intersecting said pivot opening of said first ramp interface;

a release actuator engaging said release member wherein moving said release actuator causes movement of said release member and causes said first ramp interface to pivot around said pivot member; and wherein said first ramp interface is non-conductive.

14. The terminal plug of claim 13 wherein:

said first ramp interface further comprises an incline hook having an incline side and a retaining side;

said incline side is configured to be displaced by an inserted electrical connector and said retaining side is configured to retain an inserted electrical connector; and movement of said release actuator further pivots said incline hook about said pivot member.

15. The terminal plug of claim 13 wherein:

said ramp interface comprises a plurality of pivot openings and said pivot member passes through each of said plurality of pivot openings and engages a first side of a housing and a second side of a housing.

16. The terminal plug of claim 13 further comprising:

a second ramp interface disposed in said housing, said second ramp interface is non-conductive and comprises a second ramp surface, a second incline hook, a second pivot opening, and a second release member;

a second lug disposed in said housing adjacent said second ramp interface wherein said second lug is conductive;

a second pivot member intersecting said second pivot opening of said second ramp interface;

wherein said release actuator engages said second release member and movement of said release actuator causes said first release member and said second release member to move in tandem and also cause said second ramp interface to pivot around said second pivot member.

17. The terminal plug of claim 16 wherein the ramp interfaces comprise plastic and the lugs comprise metal.

18. The terminal plug of claim 17 wherein said first ramp insert further comprises a a-first side rib extending from a first side wall and curved towards said first ramp surface and a second side rib extending from a second side wall and curved towards said first ramp surface, a first support member connected from said first side wall to said second side wall and configured to support said first lug adjacent a first ramp apex, said first incline hook extends from said first side wall and a third incline hook extends from said second side wall.

19. A locking coupling for electrical connection with an electrical connector comprising:

a housing having a housing front defining a front passage and a housing rear defining a rear passage opposite said front passage;

a ramp interface disposed in said front passage comprising a ramp surface;

an integrated release arm comprising at least one incline hook comprising an incline side facing said front passage and a retaining side facing away from said front passage, a release receiver accessible from exterior of said housing and joined to said integrated release arm;

an electrical conduit positioned adjacent said ramp surface in said front passage and extending directly to said rear passage; and wherein said electrical conduit is conductive and said ramp surface is non-conductive.

* * * * *